US005238109A

United States Patent [19]

Smith

[11] Patent Number: 5,238,109

[45] Date of Patent: Aug. 24, 1993

[54] GOLF CLUB HOLDER

[76] Inventor: Alan Smith, 31501 West St., Laguna Beach, Calif. 92677

[21] Appl. No.: 830,069

[22] Filed: Feb. 3, 1992

[51] Int. Cl.[5] ..... A63B 55/10; A63B 57/00

[52] U.S. Cl. ..... 206/315.2; 206/315.3; 206/315.6; 211/70.2

[58] Field of Search ..... 206/315.2, 315.3, 315.6; 211/70.2; 248/97; 273/32 R, 32 D, 32 E, 32 B; 224/274, 918

[56] References Cited

U.S. PATENT DOCUMENTS

| | | | |
|---|---|---|---|
| D. 149,557 | 5/1948 | Jessen | 211/70.2 X |
| 1,314,171 | 8/1919 | Vogel | 206/315.2 |
| 1,880,351 | 10/1932 | McDonald | 248/96 |
| 2,465,096 | 3/1949 | Hunt | 211/70.2 |
| 2,546,416 | 3/1951 | Alter et al. | 206/315.6 |
| 2,595,987 | 5/1952 | Shears | 211/70.2 X |
| 2,621,799 | 12/1952 | Wilson | 211/70.2 |
| 2,887,137 | 5/1959 | Robb | 206/315.2 X |
| 3,147,988 | 9/1964 | Schairer | 280/47.19 |
| 3,164,393 | 1/1965 | Upham | 280/47.19 |
| 3,172,681 | 3/1965 | Moses | 280/47.19 |
| 3,215,181 | 11/1965 | Reed | 211/70.2 |
| 3,219,083 | 11/1965 | Asquith | 211/70.2 X |
| 3,232,503 | 2/1966 | Thonen | 224/45 |
| 3,265,106 | 8/1966 | Jarman | 150/1.5 |
| 3,353,838 | 11/1967 | Schmid | 280/47.19 |
| 3,495,641 | 2/1970 | Bethel | 150/1.5 |
| 3,503,518 | 3/1970 | Black | 211/70.2 |
| 3,667,078 | 6/1972 | Distasio | 15/104.92 |
| 3,866,646 | 2/1975 | Nevard | 211/70.2 |
| 3,870,300 | 3/1975 | Amendola | 224/274 X |
| 3,941,398 | 3/1976 | Nelson | 280/47.19 |
| 3,954,239 | 5/1976 | Kerbs | 211/70.2 X |
| 3,996,983 | 12/1976 | Isnardi | 206/315.6 |
| 4,074,739 | 2/1978 | Rodeghier | 211/70.2 |
| 4,111,248 | 9/1978 | Leichhardt | 206/315.6 |
| 4,114,925 | 9/1978 | Burns | 281/45 |
| 4,154,274 | 5/1979 | Adamson | 206/315.2 |
| 4,545,579 | 10/1985 | McCain | 273/32 R X |
| 4,616,749 | 10/1986 | Briggs | 206/315.2 |
| 4,838,416 | 6/1989 | Carman | 211/70.2 X |
| 4,923,523 | 6/1990 | Yamazoe | 206/315.2 X |
| 4,960,212 | 10/1990 | Wu | 211/70.2 |
| 4,991,839 | 2/1991 | Lumbattis, Jr. | 273/32 R |
| 5,076,581 | 12/1991 | Boberg | 273/32 R |
| 5,127,530 | 7/1992 | Ortuno | 206/315.2 X |

FOREIGN PATENT DOCUMENTS

| | | | |
|---|---|---|---|
| 1479 | of 1905 | United Kingdom | 206/315.5 |

*Primary Examiner*—Sue A. Weaver

[57] ABSTRACT

An apparatus is provided for carrying and supporting several golf clubs. A plurality of parallel channels are arranged to face in a common direction. Preferably, the channels are made of a resilient material, and at least one portion of each of the channels is smaller than the diameter of a golf club shaft. When the shaft is inserted into one of the channels by forcing the channel to flex open slightly to admit the shaft, the channel then closes to hold the shaft in place inside the channel. A hook is included for hanging the device over a partition inside a golf bag. The hook further includes a spike pivotally attached to the device such that with the channels facing generally upwardly, the spike may be rotated into a position to be pushed into the ground for securing the device on the ground. In this way the golf club shafts are supported above the ground. Additionally, the spike is rotatable to a position parallel to the channels for storage of the device inside the golf bag.

3 Claims, 3 Drawing Sheets

GOLF CLUB HOLDER

FIELD OF THE INVENTION

This invention relates generally to golf club holders, and, more particularly, to a device for conveniently holding a subset of a golfer's clubs either in his golf bag or away from his golf bag.

BACKGROUND OF THE INVENTION

During a game of golf, golfers typically carry a set of golf clubs in a golf bag or the like. Some golfers then strap the golf bag to a motorized cart or a hand cart. While a golf bag provides a convenient method of carrying a set of golf clubs, and golf carts further facilitate the mobility of such clubs, it is still often impractical to carry the entire set of golf clubs to every shot.

For example, a golfer near a putting green typically needs only short-range clubs, such as a putter, a chipping wedge, or perhaps a sand wedge. As it is usually against the course rules to place a golf bag or drive a golf cart on the putting greens, golfers frequently find their entire set of clubs quite a distance from where they must actually make a shot. As a result, golfers typically carry a subset of clubs to the putting green.

Another example of the impracticality of bringing one's entire set of clubs to the ball is evident where golf courses do not allow a golf cart to be driven off of a paved trail. Many golf balls, of course, land a considerable distance from such trails. It is clearly impractical, in such a situation, to unstrap the golf bag from the golf cart every time one leaves the cart to find the ball. More likely, the golfer will try to anticipate which clubs he may need and then bring a subset of clubs with him to the ball.

In all such situations, where a golfer is away from his golf bag with a subset of his golf clubs, several problems become evident. First, after a golfer has selected the proper club for the shot, the remaining clubs are typically laid on the ground near the golfer. This not only causes the handles of these clubs to contact a potentially wet and dirty grass surface, but the possibility of forgetting these clubs after the shot is greatly increased. Moreover, while it is easy to carry one golf club, it is not always easy to carry two or three. Further, when grasping a subset of clubs around their shafts, the heads of the clubs are forced into contact with each other, leading to potential damage to the clubs. Still further, while picking golf clubs up from the ground is not all that difficult, it does require the golfer to bend down and scoop the shafts up with his hand. Not only can this be difficult for some golfers, but inevitably this causes a golfers hand or glove to become wet and soiled unnecessarily.

Prior art devices for carrying golf clubs are generally adapted to carry and organize an entire set of golf clubs. Such devices, as a result, are not well suited for a subset of golf clubs. One such device, however, disclosed in U.S. Pat. No. 3,866,646 to Nevard on Feb. 18, 1975, teaches a golf club carrier for a subset of golf clubs comprising several elongated parallel tubes each configured to received the shaft of a golf club. While such a device is suitable for carrying a subset of golf clubs, it does not intended for use with a traditional golf bag. As such, using such a device and a golf bag would be awkward, as two separate carrying devices would have to be used. Moreover, this type of device has a relatively large number of components and, consequently, is relatively expensive to manufacture.

Clearly, then, a golf club carrier device is needed that allows a subset of golf clubs to be carried conveniently while, at the same time, is readily adapted for use with a conventional golf bag. Such a device would keep the subset of golf clubs from colliding with each other, thereby reducing the risk of damage to the clubs. Moreover, such a needed device would prevent the handles of the clubs from contacting the ground when not in use. Further, such a needed device would be relatively inexpensive to manufacture and assemble, and would be easy to use and carry. The present invention fulfills these needs and provides further related advantages.

SUMMARY OF THE INVENTION

The present invention is a light weight device for carrying and supporting several golf clubs. A plurality of parallel channels are arranged to face in a common direction. Each channel includes a means for retaining a golf club shaft therein. Preferably, the channels are made of a resilient material, and at least one portion of each of the channels is smaller than the diameter of a golf club shaft. When the shaft is inserted into one of the channels by forcing the channel to flex open slightly to admit the shaft, the channel then closes to hold the shaft in place inside the channel.

A securing means, such as a hook, is included for hanging the device over a partition inside a golf bag. The securing means further includes a spike pivotally attached to the device such that with the channels facing generally upwardly, the spike may be rotated into a position to be pushed into the ground for securing the device on the ground. In this way the golf club shafts are supported above the ground. Additionally, the spike is rotatable to a position parallel to the channels for storage of the device inside the golf bag.

In operation, a golfer selects a subset of golf clubs to snap into the device. The golfer then carries the subset of clubs, as a unit, to the ball. When at the ball, the golfer can make a more accurate determination as to which club will actually be needed. He pulls the club from the appropriate channel, pivots the spike out from the securing means, sets the device on the ground, and lightly pressed the end of the spike into the ground to secure the device 10 in place. The golfer then hits the golf ball, returns the club back to the device by pressing the shaft into the empty channel, rotates the spike into a parallel position with the channels, and either carries the device to the next shot to repeat the process or to the golf bag, hanging the device over the partition inside the golf bag.

The present invention allows a golfer to conveniently carry a subset of his golf clubs with his golf bag or away from his golf bag. Moreover, when the present invention is set on the ground, the handles of the golf clubs are prevented from contacting the ground, thereby keeping the handles clean. The invention is lightweight, inexpensive to manufacture, and easy to use with any type of golf club. Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
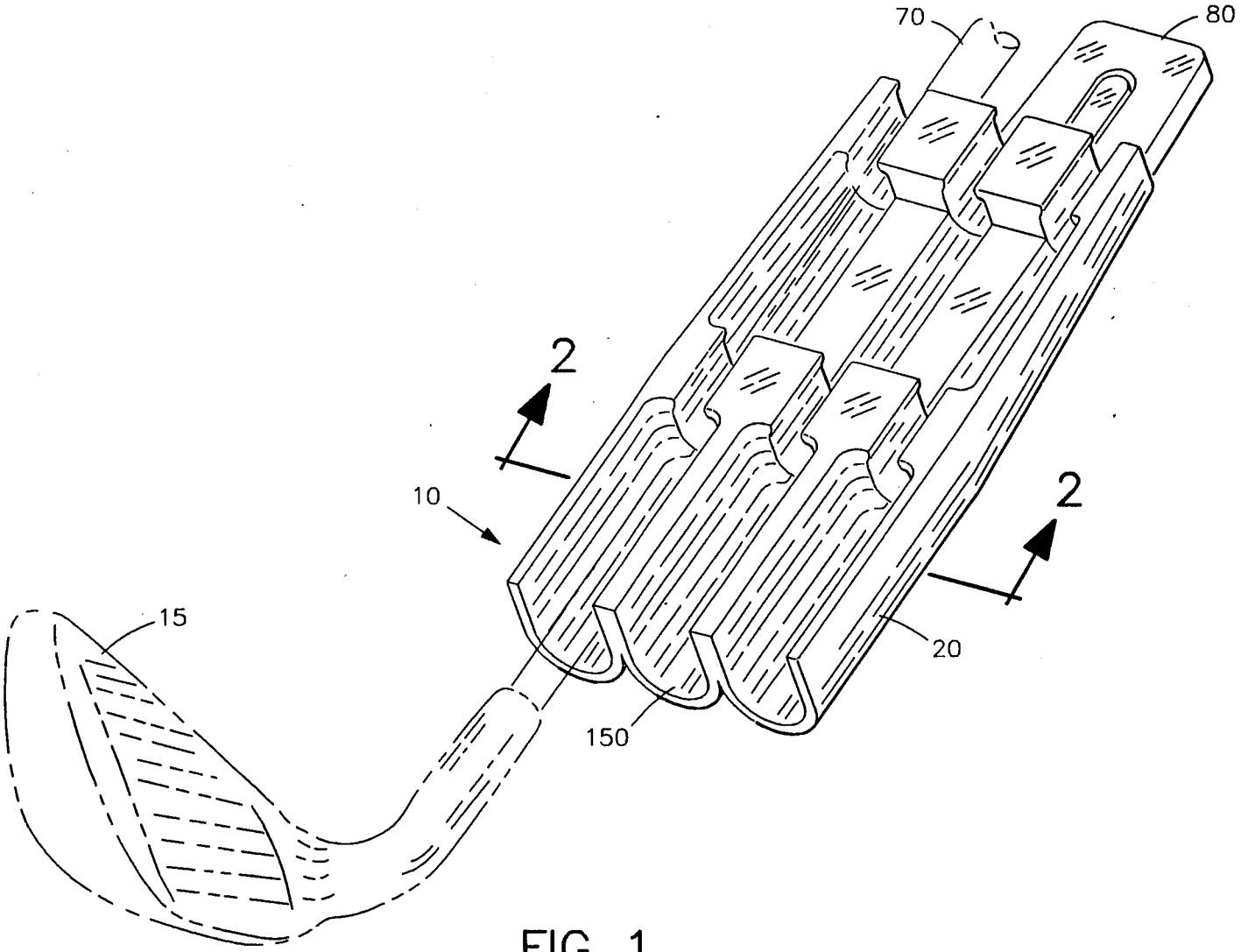
FIG. 1 is a perspective illustration of the invention, illustrating in phantom outline a golf club retained within a channel of the invention.
Figure 2:
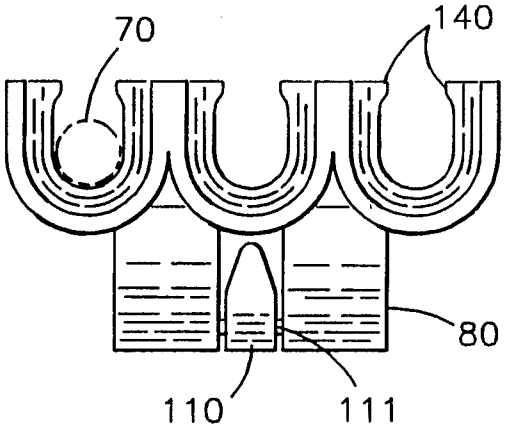
FIG. 2 is a cross-sectional view of the invention, taken generally along lines 2—2 of FIG. 1.

FIG. 1 shows a light weight device 10 for carrying and supporting several golf clubs 15. A plurality of U-shaped cross section parallel channels 20 are arranged to face in a common direction. Each channel 20 has the ability to retain a golf club shaft 70 therein. Preferably, the channels 20 are made of a resilient material, and at least one portion 140 of each of the channels 20 is more narrow than the diameter of a golf club shaft 70 (FIG. 2). When the shaft 70 is inserted into one of the channels 20 by forcing the channel 20 to flex open slightly to admit the shaft 70, the channel 20 then closes to hold the shaft 70 in place inside the channel 20.

Figure 3:
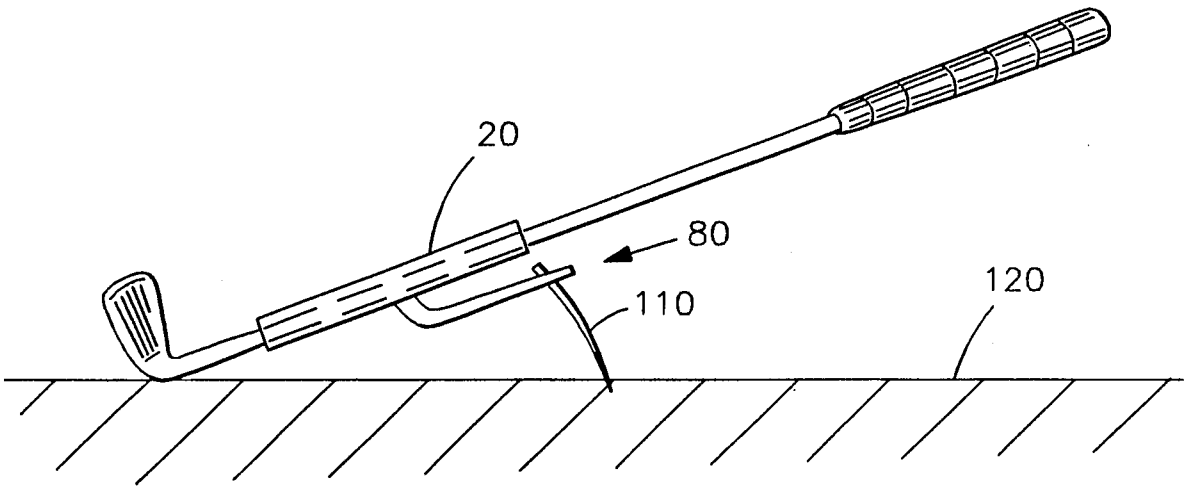
FIG. 3 is a left side elevational view of the invention, illustrating a spike of the invention as inserted in the ground to hold the shafts of golf clubs above the ground.
Figure 4:
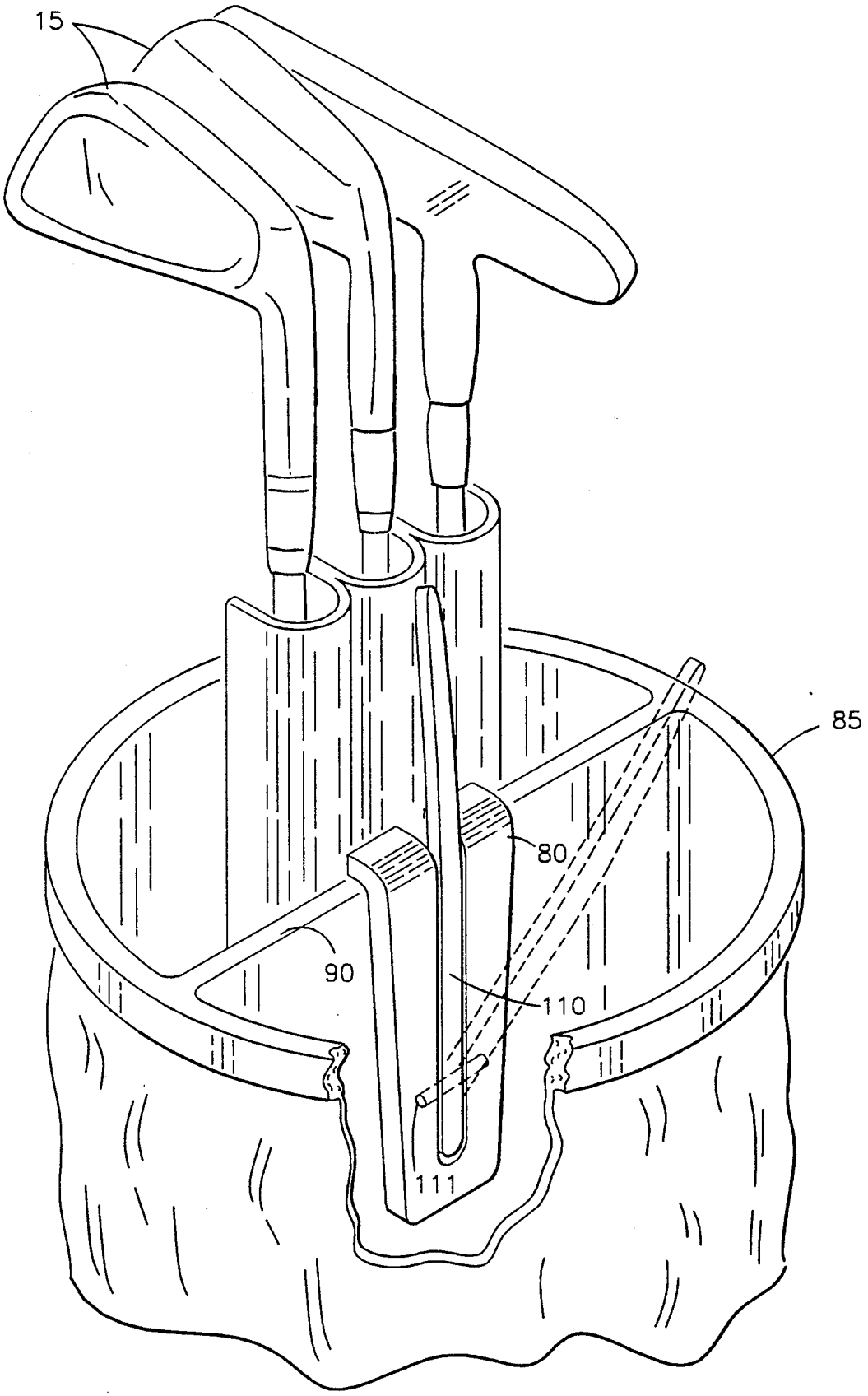
FIG. 4 is a perspective illustration of the invention, illustrating golf clubs supported by the invention on a golf bag partition.

A securing means 80, such as a hook or L-shaped bracket, is included for hanging the device 10 over a partition 90 inside a golf bag 85 (FIG. 4). The securing means 80 further includes a spike 110 pivotally attached by a pivot pin 111 to the device 10 such that with the channels 20 facing generally upwardly, the spike 110 may be rotated into a position to be pushed into the ground 120 for securing the device 10 on the ground 120. In this way the golf club shafts 70 are supported above the ground 120 (FIG. 3). Additionally, the spike 110 is rotatable to a position parallel to the channels 20 for storage of the device inside the golf bag 85. Preferably, the device 10 is manufactured from a light-weight yet strong material such as plastic or wood.

In operation, a golfer selects a subset of golf clubs 15 to snap into the device 10. The golfer then carries the subset of clubs 15, as a unit, to the ball (not shown). When at the ball, the golfer can make a more accurate determination as to which club 15 will actually be needed. He pulls the club 15 from the appropriate channel 20, pivots the spike 110 out from the securing means 80, sets the device 10 on the ground 120, and lightly pressed the end of the spike 110 into the ground 120 to secure the device 10 in place. The golfer then hits the golf ball, returns the club 15 back to the device 10 by pressing the shaft 70 into the empty channel 20, rotates the spike 110 into a parallel position with the channels 20, and either carries the device 10 to the next shot to repeat the process or the device 10 to the golf bag 85, hanging the device 10 on the partition 90 inside the golf bag 85.

While the invention has been described with reference to a preferred embodiment, it is to be clearly understood by those skilled in the art that the invention is not limited thereto. Rather, the scope of the invention is to be interpreted only in conjunction with the appended claims.

I claim:

1. A device for carrying and supporting golf clubs, comprising a plurality of parallel, channels, each of the channels providing a transverse U-shaped cross-sectional structure with opposing open channel ends, said channels arranged to face in a common direction, and further providing a means for retaining a shaft of a golf club within the U-shaped structure so that a head of the golf club is positioned adjacent to one of the opposing open ends, while the bulk of the golf club shaft and a golf club hand grip extends from the other of the opposing ends, the device further including a means for securing the device on the top edge of a partition in a golf club bag such that the shafts of the golf clubs retained by the device are held within the golf club bag in alignment with other golf clubs in the golf club bag, and the heads of the golf clubs retained by the device are held in positions near the top of the golf club bag within easy reach for club selection and removal from the device, the device further including a spike and means for pivotal attachment to the device so that the spike is positionable in alignment with the securing means when the device is mounted in the golf club bag, the spike being alternatively positionable for inserting the spike into the ground such that the channels are held such that the golf clubs within the channels are held above the ground with the hand grips elevated above the ground in position for selection.

2. The device of claim 1 wherein the securing means is an L-shaped bracket formed integrally with the channels so that with the partition in the golf club bag inserted between the channels and the L-shaped bracket the device is securely held in the golf club bag, the partition being wedged between the channels and the L-shaped bracket.

3. The device of claim 1 wherein the retaining means comprises one portion of each of the channels being more narrow than the shaft of a golf club such that the shaft must be forced past the one portion in order to enter into one of the channels, the shaft thereby being removably captured within the one of the channels.

* * * * *